US006270655B1

(12) United States Patent
Ganguli

(10) Patent No.: US 6,270,655 B1
(45) Date of Patent: Aug. 7, 2001

(54) CATALYTIC HYDROCONVERSION OF CHEMICALLY DIGESTED ORGANIC MUNICIPAL SOLID WASTE MATERIALS

(75) Inventor: Partha S. Ganguli, Princeton, NJ (US)

(73) Assignee: Hydrocarbon Technologies, Inc., Lawrenceville, NJ (US)

( * ) Notice: Subject to any disclaimer, the term of this patent is extended or adjusted under 35 U.S.C. 154(b) by 0 days.

(21) Appl. No.: 09/533,000

(22) Filed: Mar. 22, 2000

Related U.S. Application Data

(63) Continuation-in-part of application No. 09/099,982, filed on Jun. 19, 1998, now abandoned.

(51) Int. Cl.[7] ..... C10G 1/00; C07C 4/00

(52) U.S. Cl. ..... 208/85; 585/241; 585/242; 585/240

(58) Field of Search ..... 585/240, 241, 585/242; 208/85

(56) References Cited

U.S. PATENT DOCUMENTS 5,079,385 * 1/1992 Wu ..... 585/241
5,705,722 * 1/1998 Monnier et al. ..... 585/240
6,000,639 * 12/1999 Ganguli ..... 241/17

* cited by examiner

*Primary Examiner*—Walter D. Griffin
*Assistant Examiner*—Tam M. Nguyen
(74) *Attorney, Agent, or Firm*—Fred A. Wilson

(57) ABSTRACT

A hydrocarbon liquid feedstock containing at least 50 wt. % chemically digested organic-MSW material is catalytically hydroconverted utilizing either a single stage or two-stage catalytic reaction process to produce desirable lower-boiling hydrocarbon liquid products. The catalyst can be either a particulate supported type catalyst such as containing cobalt and/or molybdenum and/or nickel on alumina support, or a dispersed slurry type catalyst containing mainly iron oxide with anions of molybdate, phosphate, sulfate or tungstate, and combinations thereof. Broad useful reaction conditions are 600–860° F. (315–460° C.) temperature, 1000–3000 psi hydrogen partial pressure, and fresh feed rate of 20–60 pounds/hr/ft$^3$ reactor volume. Effluent material from the final stage catalytic reactor is phase separated and the resulting liquid portion is fractionated to produce the desired low-boiling hydrocarbon liquid products particularly useful as transportation fuels. If desired, the chemically digested organic-MSW feedstock can be blended with petroleum residua and/or particulate coal and/or mixed waste plastics and the blended feed material processed in catalytic two-stage reactors to produce similar desirable low-boiling hydrocarbon liquid products.

21 Claims, 4 Drawing Sheets

CATALYTIC HYDROCONVERSION OF CHEMICALLY DIGESTED ORGANIC MUNICIPAL SOLID WASTE MATERIALS

This is a continuation-in-part application of Ser. No. 09/099,982, filed Jun. 19, 1998, and now abandoned.

BACKGROUND OF INVENTION

This invention pertains to catalytic hydroconversion of hydrocarbon feed materials derived by chemical digestion from organic municipal solid waste (MSW) materials. It pertains particularly to a process for catalytic hydroconversion of such chemically digested organic-MSW feed materials, either alone or blended with heavy oils and/or particulate coal, to produce desirable low boiling hydrocarbon liquid products particularly useful as fuels.

Great quantities of municipal solid waste (MSW) materials are continuously generated in the United States as well as in other developed countries and require appropriate disposal methods, such as usually by incineration or dumping in landfills. Such MSW materials include varying percentages of both organic and inorganic material portions. A process for treating such MSW materials to first concentrate the organic material portion by density separation in a suitable liquid medium, followed by digestion of the organic portion in the same or similar liquid medium to produce unique digested hydrocarbon fuel products has been disclosed in my co-filed U.S. Pat. No. 6,000,639. Although such carbonaceous fuel products derived from organic-MSW materials can be used as clean heavy liquid slurry or solid fuels, it is also desirable to further catalytically hydroconvert this unique heavy carbonaceous material to produce higher value low boiling hydrocarbon liquid products which are useful as transportation fuels. Also, such heavy hydrocarbon materials derived from organic-MSW could be advantageously mixed with and catalytically co-processed together with petroleum residua and/or particulate coal and/or mixed waste plastics to produce similar desirable low-boiling hydrocarbon liquid products useful as transportation fuels.

Catalytic co-processing of blended coal and petroleum residua feedstocks to produce hydrocarbon liquid products is generally known, as is disclosed by U.S. Pat. No. 4,054,504 to Chervenak et al and U.S. Pat. No. 4,853,111 to MacArthur et al. Also U.S. Pat. No. 5,705,722 to Monnier et al discloses a catalytic hydroconversion process for selected biomass liquid carboxylate feed materials such as blended tall oils, wood oils, animal fats and such fatty acids to produce specific light hydrocarbon liquid products. However, a suitable process for catalytic hydroconversion of unique hydrocarbon feed materials from chemically digested organic-MSW sources for producing desirable lower-boiling hydrocarbon liquid products has not been previously available.

SUMMARY OF INVENTION

This invention provides a process for catalytic hydroconversion of heavy hydrocarbon feed materials derived by chemical digestion of the organic portion of municipal solid waste (MSW) to produce desirable low-boiling hydrocarbon liquid products. This unique organic-MSW feed material has been chemically digested in a polar acidic organic liquid such as phenol and is mainly aromatic but with significant portions of unsaturated aliphatic compounds and hydrogen bonded hydroxyl groups, but without any carbonyl groups. This digested organic-MSW feed material can be in either heavy liquid and/or slurry form containing particulate solids, depending upon its prior processing, and has a unique chemical composition as compared to petroleum residua and coal as follows:

| Composition | Digested Organic-MSW | Petroleum Residua | Bit-uminous Coal | Sub-bit-uminous Coal |
|---|---|---|---|---|
| Carbon, wt. % | 75–79 | 80–84 | 69.9 | 70.1 |
| Hydrogen, wt. % | 6–7.5 | 10.1–10.7 | 4.6 | 4.6 |
| Oxygen, wt. % | 14.5–17 | 0.7–1.4 | 10.5 | 14.5 |
| Sulfur, wt. % | 0.2–0.5 | 3.5–5.7 | 4.3 | 0.4 |
| Nitrogen, wt. % | 0.01–0.05 | 0.4–0.5 | 1.2 | 1.3 |
| Ash + Metals, wt. % | 0.01–0.1 | 0.8–3.4 | 9.5 | 9.2 |
| Carbon/Hydrogen Weight Ratio | 10–13.2 | 7.5–8.3 | 15.1 | 15.2 |
| Specific Gravity | 0.55–0.6 | 0.7–0.75 | 0.8–0.85 | 0.75–0.8 |
| Heating Value, Btu/lb | 14,000–16,000 | 17,500 | 12,540 | 12,500 |

It is noted that this unique chemically digested organic-MSW feed material has carbon and hydrogen contents less than for petroleum residua but significantly greater than for coal. Oxygen content for the chemically digested organic-MSW material is considerably greater than for petroleum resid but is comparable to coal, while sulfur and nitrogen are both significantly less than for either petroleum resid or coal, and the ash plus metals content is advantageously very low.

This unique chemically digested organic-MSW feed material also has chemical composition significantly different from other biomass type feed materials, such as those consisting of blends of tall oils, wood oils, and animal fats, which are generally fatty acids or esters of fatty acids. Such materials are straight chain unsaturated fatty acids having high hydrogen/carbon atomic ratios 1.8–2.0, and have a predominately carboxylate group characteristic. But for the present chemically digested organic-MSW feedstock when characterized by infrared (IR) analysis, the IR spectra indicates the presence of mainly aromatic structure by having wave number peaks located between about 700–1660 wavenumbers, Also, incorporated in the digested organic-MSW feed material is the presence of intermolecularly hydrogen-bonded hydroxyl groups which occur between about 2800–3500 wavenumbers. Notably absent from the IR spectra for the chemically digested organic-MSW feed material are peaks associated with a carbonyl functionality (1700–1750 wavenumbers), so that this feed material is essentially non-carbonyl in its composition and contains unsaturated short chain compounds having significant aromatic character and low hydrogen/carbon atomic ratios of only 1.0–1.2 and is usually solid at room temperatures. For these reasons, this chemically digested organic-MSW material is a new and unique feedstock which is being advantageously further treated by catalytic hydroconversion reactions for producing desirable low-boiling hydrocarbon liquid products, such as gasoline, kerosene and diesel fuels.

In the process of this invention, the unique chemically digested organic-MSW feedstock material is pressurized, heated and fed together with hydrogen into a catalytic reactor. Because the digested organic-MSW feedstock contains minimal ash and metals, the reactor may contain a fixed bed of a known particulate hydroconversion catalyst. Alternatively, the reactor may contain an ebullated or fluidized bed of a known particulate hydroconversion catalyst, or a fine sized dispersed slurry type hydroconversion catalyst. Suitable particulate catalysts contain small amounts such as 0.5–10 wt. % of an active metal(s) such as cobalt, iron molybdenum, or nickel and combinations thereof deposited on a support such as alumina, carbon or silica and combinations thereof. A suitable slurry type catalyst may contain mainly iron oxide and anions of molybdate, phosphate, sulfate or tungstate or combination thereof in either a gel or dried particle form, and is disclosed in U.S. Pat. No. 5,866,501 to Pradhan et al, which is incorporated herein by reference to the extent necessary to adequately disclose the catalyst. The slurry type catalyst loading should be sufficient to provide 500–10,000 wppm iron in the feedstream. The dispersed slurry type catalyst is usually preferred because of its greater surface area and increased catalytic activity. The chemically digested organic-MSW feed material is somewhat more aliphatic and less aromatic and has more oxygenic bonds than petroleum or coal-derived feedstocks, and is also significantly lower in nitrogen and sulfur compounds. Consequently, hydrotreating and hydroconversion reactions for the unique chemically digested organic-MSW feed material alone can be successfully accomplished in a single stage catalytic reactor.

Although this catalytic hydroconversion process for such digested organic-MSW feedstocks can successfully utilize a single stage catalytic reactor, use of two staged catalytic fluidized bed reactors connected together in a series flow arrangement is usually preferred for achieving higher percentage hydroconversion of the feedstock, particularly if the organic-MSW feedstock is blended with a heavy petroleum residua and/or particulate coal and/or mixed waste plastics and mixtures thereof, so as to provide a blended carbonaceous feed material containing at least 50 wt. % of the chemically digested organic-MSW material. Broad useful reaction conditions within the catalytic reactor(s) are 600–860° F.(315–460° C.) temperature, 1000–3000 psi. hydrogen partial pressure; and space velocity of 20–60 pounds of fresh feed per hour per cubic feet of reactor volume, which is equivalent to a liquid hourly space velocity (LHSV) of 0.5–1.8 $hr^{-1}$ depending on specific gravity of the feed material. Because this chemically digested organic-MSW hydrocarbon feedstock has moderately high oxygen content, it can be hydrocracked or hydroconverted at relatively less severe operating conditions than required for petroleum residua or coal feeds alone. Also, because the chemically digested organic-MSW hydrocarbon feedstock has low sulfur, nitrogen and ash contents, less hydrogen consumption is required, less formation of the undesirable products and less deactivation of the catalyst occurs, and greater yields of clean oxygenated hydrocarbon liquid fuel products can be provided.

From the final stage catalytic reactor, the effluent material including gas and liquid portions is phase separated, and the gas portion is removed and purified to recover hydrogen for recycle to the catalytic reactor(s) in the process. The remaining liquid portion is pressure-reduced and fractionated into gas and liquid fractions, each having a normal boiling range selected to yield the desired hydrocarbon gas and liquid products.

In an alternative process, the unique chemically digested organic-MSW feedstock material can be blended with heavy petroleum oil or residua and/or slurried together with particulate coal and/or mixed waste plastics to provide a blended carbonaceous feed material containing at least 50 wt. % chemically digested organic-MSW material, and preferably containing 60–90 wt. % organic-MSW material. For co-processing such blended feeds and for which the petroleum resid or coal contains impurities such as metals, nitrogen and sulfur compounds, two staged catalytic fluidized bed reactors are preferred for achieving desired demetallization and desulfurization reactions for the blended feedstock. Because coal is highly aromatic and contains significant percentages of sulfur and nitrogen compounds, coal requires considerable catalytic hydrogenation before these compounds can be hydrocracked and converted to produce desired low-boiling hydrocarbon liquid products such as transportation fuels. For such co-processing of the chemically digested organic-MSW material with coal using two catalytic reactor stages, the first stage catalytic reactor is mainly for hydrogenation reactions and the second stage catalytic reactor provides more hydrocracking reactions. For the blended feedstreams broad reaction conditions are 700–860° F. temperature, 1500–3000 psi; hydrogen partial pressure, and space velocity of 20–50 pounds of combined feed per hour per cubic feet of reactor total volume. The resulting low-boiling hydrocarbon liquid products from such coprocessing of the blended feedstocks will have characteristics similar to those products produced from the chemically digested organic-MSW feedstock alone, except for containing somewhat more metals and sulfur impurities.

Because the chemically digested organic-MSW hydrocarbon feedstock portion contains low sulfur, nitrogen and essentially no ash, coprocessing the digested organic-MSW feedstock blended with the other petroleum and/or coal hydrocarbon feed material requires less severe overall reaction conditions than for petroleum and/or coal feed materials alone. Because the chemical composition of the digested organic-MSW feedstock is less aromatic than coal, such coprocessing will require somewhat less hydrogen consumption, the catalyst requirement and severity of operating conditions requirement will be advantageously reduced, and more desirable chemical or fuel components can be produced. For such coprocessing operations, the chemically digested organic-MSW feedstock may yield more oxygenated products, some of which are desirable components of the liquid fuels. Because of the low concentrations of sulfur and nitrogen in this organic-MSW feedstock, the resulting hydrocarbon liquid fuel products will more fully meet prevailing clean air standards.

This invention advantageously provides a catalytic single stage or two-stage hydroconversion process by which a chemically digested heavy hydrocarbon feed material derived from the organic portion of municipal solid waste materials (organic-MSW) is catalytically hydroconverted to produce more desirable lower-boiling hydrocarbon liquid products, which are particularly useful as transportation fuels. Alternatively, the chemically digested organic-MSW feed material can be blended with heavy oils and/or mixed particulate coal and/or mixed solid plastic waste and coprocessed in a catalytic two-stage hydrogenation and hydroconversion process to produce such desirable low-boiling hydrocarbon liquid products.

BRIEF DESCRIPTION OF DRAWINGS

This invention will be described further with reference to the following drawings, in which.

DESCRIPTION OF INVENTION

Figure 1:
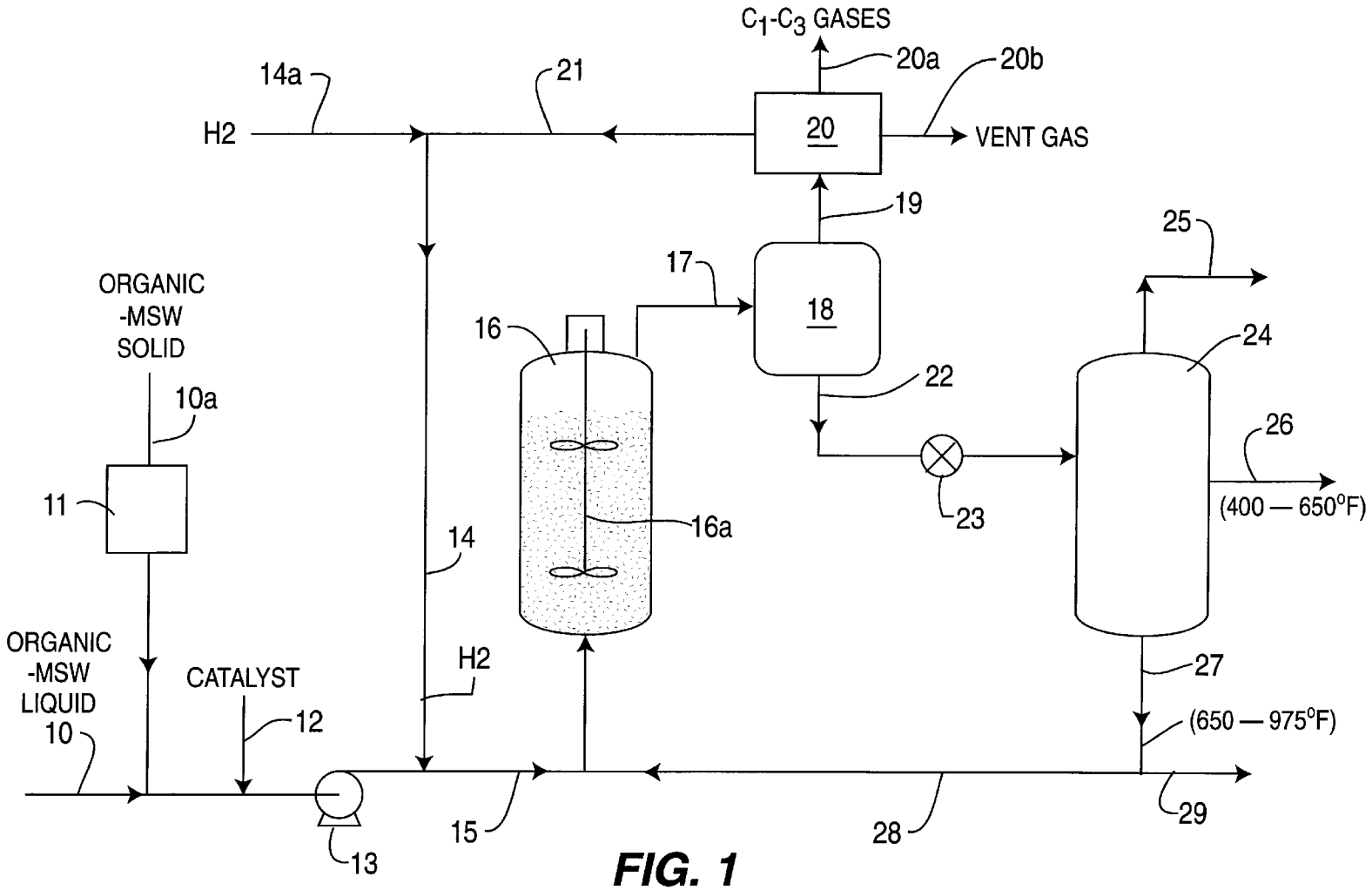
FIG. 1 is a schematic flow diagram of a catalytic single stage hydrotreating/hydroconversion process for unique chemically digested organic-MSW feedstocks to produce desirable low-boiling hydrocarbon liquid products according to the invention.

As shown in FIG. 1, a hydrocarbon feed material is provided containing at least 50 wt. % and preferably 60–80 wt. % chemically digested organic-MSW, and may be either a heavy liquid slurry provided at 10 or partially as a solid form supplied at 10*a*. When the chemically digested organic-MSW feed material is in solid form, it is pulverized at 11 to provide fine particle size smaller than about 0.125 inch and is slurried with a suitable oil. The resulting feed material in liquid or slurry form has a suitable dispersed slurry type catalyst provided at 12, and is pressurized by feed pump 13 and mixed with pressurized hydrogen at 14, then heated and fed as feedstream 15 into a catalytic reactor 16. The dispersed slurry type catalyst at 12 should be sufficient to provide 500–10,000 wppm iron in the feedstream. In the reactor, the reacting feed material and catalyst are usually recycled internally such as by a suitable mixing device 16*a* or a recycle pump arrangement to provide a back-mixed continuous stirred action.

Figure 3:
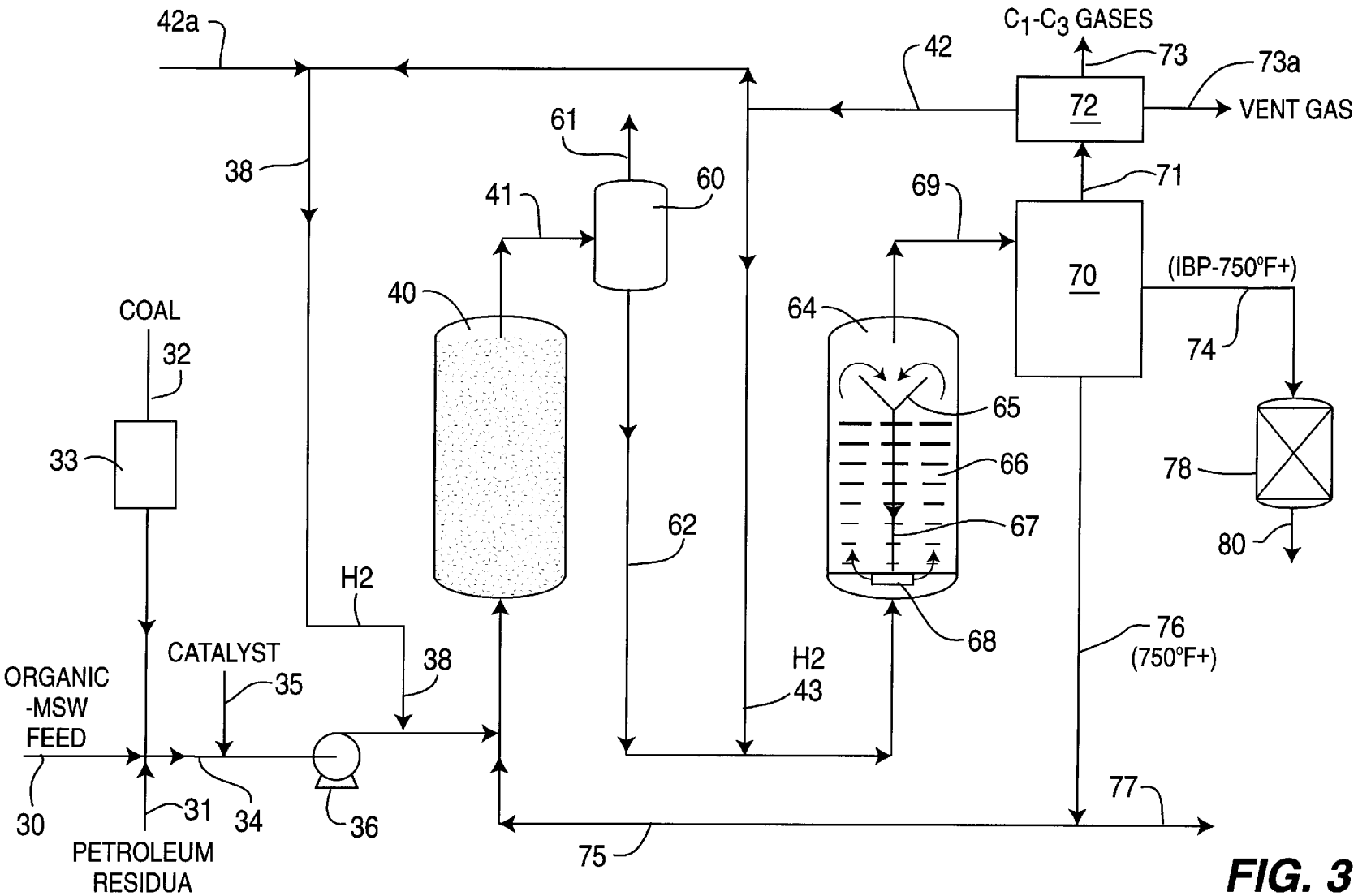
FIG. 3 shows an alternative two-stage process similar to FIG. 2, but which utilizes a dispersed slurry type catalyst in the first stage reactor and a particulate supported type catalyst in the second stage reactor and includes an inter-stage phase separation step.

Broad operating conditions in reactor 16 are maintained at 600–860° F. (315–460° C.) temperature and 1000–3000 psi hydrogen partial pressure at fresh feed rate of 20–60 pounds per hour per cubic feet of total reactor volume to provide hydroconversion reactions for the chemically digested organic-MSW feedstock. Preferred reaction conditions for hydroprocessing the organic-MSW feedstock alone are 650–840° F. (410–450° C.) temperature, 1500–2500 psig hydrogen partial pressure and a feed rate of 30–60 lb/hr/ft$^3$. If the reactor 16 contains an expanded or ebullated bed of a known particulate supported type catalyst, a suitable internal gas-liquid separation device such as shown in FIG. 3 is usually provided in the reactor upper portion to provide substantially vapor-free liquid to a recycle pump for maintain the catalyst bed in a suitable expanded condition.

From the reactor 16, an effluent stream 17 containing vapor and liquid portions is removed and passed to phase separator 18, from which the vapor portion at 19 containing $C_1$–$C_3$ gases, hydrogen and some impurities is passed to a purification/treatment section 20 in which the hydrogen is purified. From the purification section 20, the hydrogen gas 21 is recycled as stream 14, with make–up hydrogen provided at 14*a* as needed. The $C_1$–$C_3$ gases are removed at 20*a*, and a vent gas stream containing impurities is discarded at 20*b*. Also from the separator 18, the liquid portion 22 is pressure-reduced at 23 to less than about 200 psi and passes to fractionation tower 24. From the tower 24, a gas fraction is removed at 25, a hydrocarbon liquid product stream having normal boiling range of 400–650° F. is withdrawn at 26, and a heavy liquid fraction having normal boiling range of 650–975° F is withdrawn at 27. A portion 28 of the heavy liquid fraction 27 containing unreacted feed material and slurry catalyst is recycled back to the reactor 16, and a net heavy liquid slurry product is withdrawn at 29.

Figure 2:
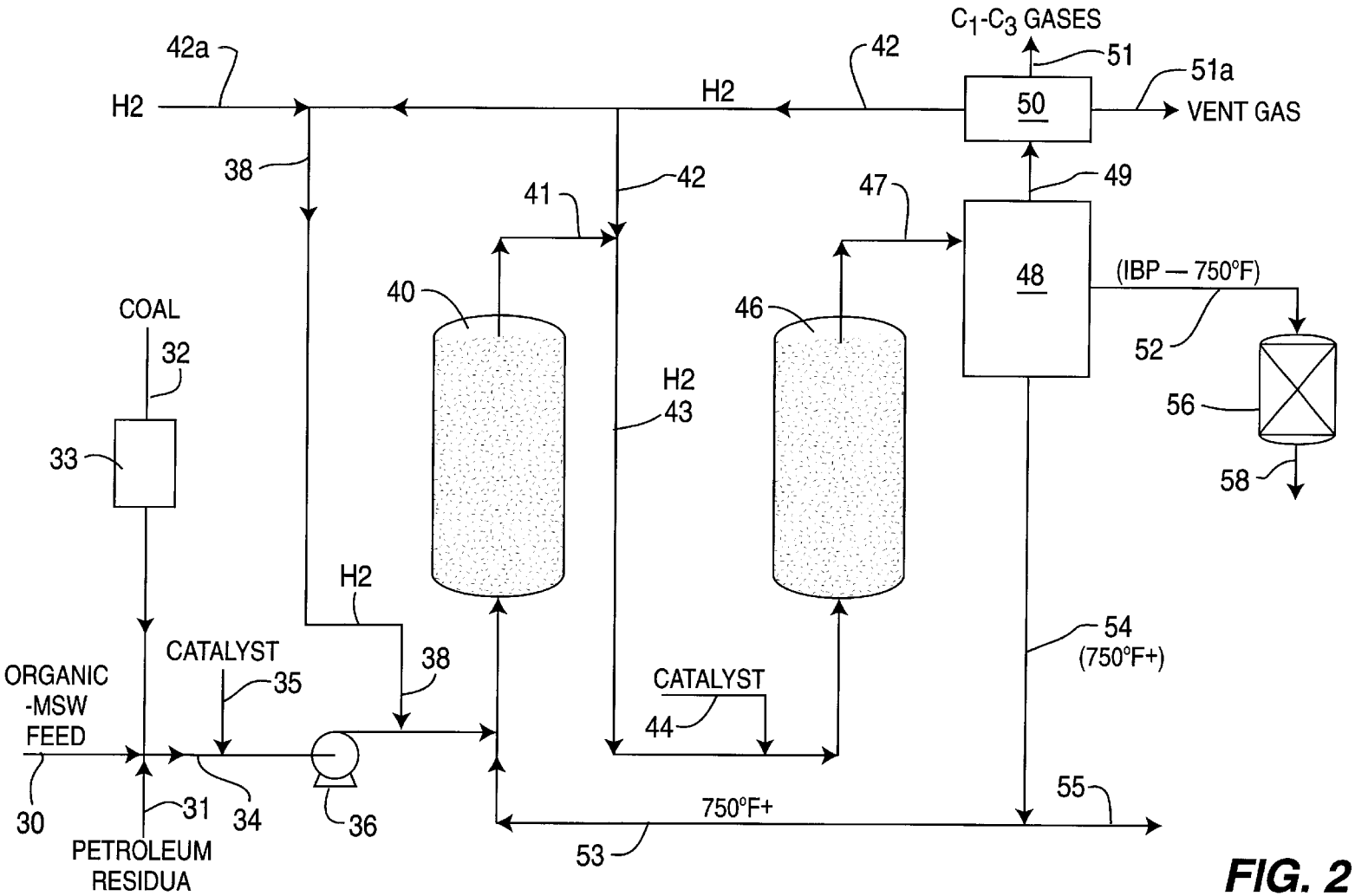
FIG. 2 is a schematic flow diagram of a catalytic two-stage hydrotreating/hydroconversion process for such digested organic-MSW feedstocks blended with petroleum residua and/or particulate coal and utilizing a dispersed slurry type catalyst to produce low-boiling hydrocarbon liquid products according to the invention.

For achieving higher percentage hydroconversion of the unique chemically digested organic-MSW feedstock alone, or when the digested organic-MSW feed material is blended with a smaller percentage of petroleum residua and/or particulate coal, a catalytic two-stage hydrotreating/hydroconversion process is usually utilized. As shown by FIG. 2, the chemically digested organic-MSW feed material is provided at 30 and blended with either petroleum residua provided at 31 and/or with coal provided at 32 and pulverized at 33, so as to provide a blended hydrocarbon feedstream at 34 containing at least 50 wt. % chemically digested organic-MSW material. This blended feedstream 34 together with a slurry type catalyst containing mainly iron oxide and provided at 35 is pressurized by feed pump 36 and has pressurized hydrogen added at 38, and all are heated as needed and fed into a first stage back-mixed catalytic reactor 40. For the blended feestream, the reactor 40 is maintained at broad reaction conditions of 700–860° F. (371–460° C.) temperature and 1500–3000 psi hydrogen partial pressure, and a fresh feed rate of 20–50 lb/hr/ft$^3$ reactor total volume for providing hydroconversion reactions therein. Preferred reaction conditions are 750–850° F. temperature, 1800–2500 psig hydrogen partial pressure and feed rate of 25–45 lb/hr/ft$^3$ reactor volume.

From the first stage reactor 40, partially reacted effluent material is removed at 41, additional hydrogen is added at 42 to form stream 43, additional slurry catalyst is provided at 44 as needed, and all are passed together into a second stage catalytic reactor 46, which is back-mixed similarly to the reactor 40 and provides further catalytic reactions therein. Broad and preferred reaction conditions in the second stage reactor 46 are generally the same as for first stage reactor 40.

From the second stage reactor 46, an effluent stream is removed at 47 and further processed in a series of high and low pressure gas-liquid separators and a distillation tower all provided in refining section 48. A vapor stream including light $C_1$–$C_3$ hydrocarbons together with $H_2$, CO, $C0_2$, $NH_3$, and $H_2S$ is withdrawn at 49. The vapor stream 49 is purified in purification/treatment section 50 similarly as for the section 20 in FIG. 1, and hydrogen at 42 along with make-up hydrogen provided at 42*a* as needed is recycled at 38 back to the first stage reactor 40, and at 42 to second stage reactor 46. A $C_1$–$C_3$ gas stream is removed at 51 and vent gas stream containing impurities is removed at 51*a* from the purification/treatment section 50.

From the refining section 48, a hydrocarbon light liquid product stream having a typical normal boiling range of IBP-750° F. is withdrawn at 52, and a heavier 750° F.+ liquid slurry stream 54 which may contain some fine dispersed catalyst is withdrawn, and a portion recycled at 53 back to the first stage reactor 40 for further hydroconversion of any unconverted residua materials. A net heavy liquid product and any contained solids are removed as stream 55. If desired for improving the quality of the light distillate liquid in the stream 52, it may be further hydrotreated in an in-line catalytic fixed–bed hydrotreater 56 provided to yield a hydrocarbon liquid product at 58 having lower heteratom ($N_2$, S, $O_2$) content.

An alternative catalytic two-stage hydrotreating and hydroconversion process for the chemically digested organic-MSW feedstock blended with petroleum resid and/or particulate coal and/or mixed waste plastics is shown in FIG. 3. This alternative process is similar to that described and shown for FIG. 2, in that the chemically digested organic-MSW liquid feedstock at 30 together with petroleum residua 31 and/or particulate coal from 32 and 33 are blended together with a slurry type catalyst containing mainly iron oxide provided at 35. The resulting blended feedstream is pressurized at pump 36 and has hydrogen added at 38, and all are heated as needed and fed together to the first stage reactor 40 utilizing the dispersed slurry type catalyst. However; the first stage reactor 40 effluent stream 41 is passed to an interstage gas-liquid separator 60, from which a vapor portion 61 is removed and the remaining liquid/slurry portion 62 is passed with additional hydrogen provided at 42 and 43 to a second stage catalytic reactor 64. The reactor 64 contains an ebullated bed 66 of a known particulate supported type catalyst such as cobalt-molybdenum on alumina beads or extrudates. The fine sized dispersed slurry catalyst contained in the effluent streams 41 from the first stage reactor 40 and in the liquid/slurry stream 62 passes through the expanded particulate catalyst bed 66 in the second stage reactor 64. Reactor liquid is re–circulated internally in reactor 64 from an internal gas/liquid separation device 65 through inner conduit 67 and recycle pump 68 as needed to maintain the catalyst bed 66 in an expanded condition of 25–50% above its normal settled height. Broad and preferred reaction conditions are generally the same as for the FIG.2 process.

From the second stage reactor 64, the effluent stream 69 containing gas and liquid portions is passed to a product refining section 70, which contains a series of phase separation and distillation steps and is operated similarly to refining section 48 for the process per FIG. 2. The gas separation, heavy liquid/slurry product recycle and solids separation steps are all handled similarly as for the FIG. 2 process. For the process as shown in FIG. 3, a gas stream containing $C_1$–$C_3$ hydrocarbons together with $H_2$, CO, $CO_2$, $NH_3$ and $H_2S$ impurities is removed at 71, and passed together with the vapor stream 61 to purification/treatment unit 72 to provide the purified hydrogen streams 42 and 38. Fresh hydrogen is added at 42*a* as needed. A $C_1$–$C_3$ gas stream is removed at 73, and a vent gas stream containing impurities such as CO, $CO_2$, $H_2S$ and $NH_3$ is removed at 73*a*.

From refining section 70, a light hydrocarbon liquid product (80–750° F. boiling range) is withdrawn at 74 as the net process distillate product. A portion 75 of heavy 750° F.+ liquid stream 76 may be recycled back to the first stage reactor 40 for further hydroconversion reactions, and a remaining stream 77 is withdrawn as heavy hydrocarbon liquid product. If desired, the distillate liquid product at 74 may be further processed through an in-line catalytic fixed-bed hydrotreating reactor 78, so that the resulting improved distillate product at 80 has high hydrogen content and lower heteroatom ($N_2$, S, $O_2$) content.

This invention will be described further with the aid of the following examples, which should not be construed as limiting the scope of the invention.

EXAMPLE No. 1

Figure 4:
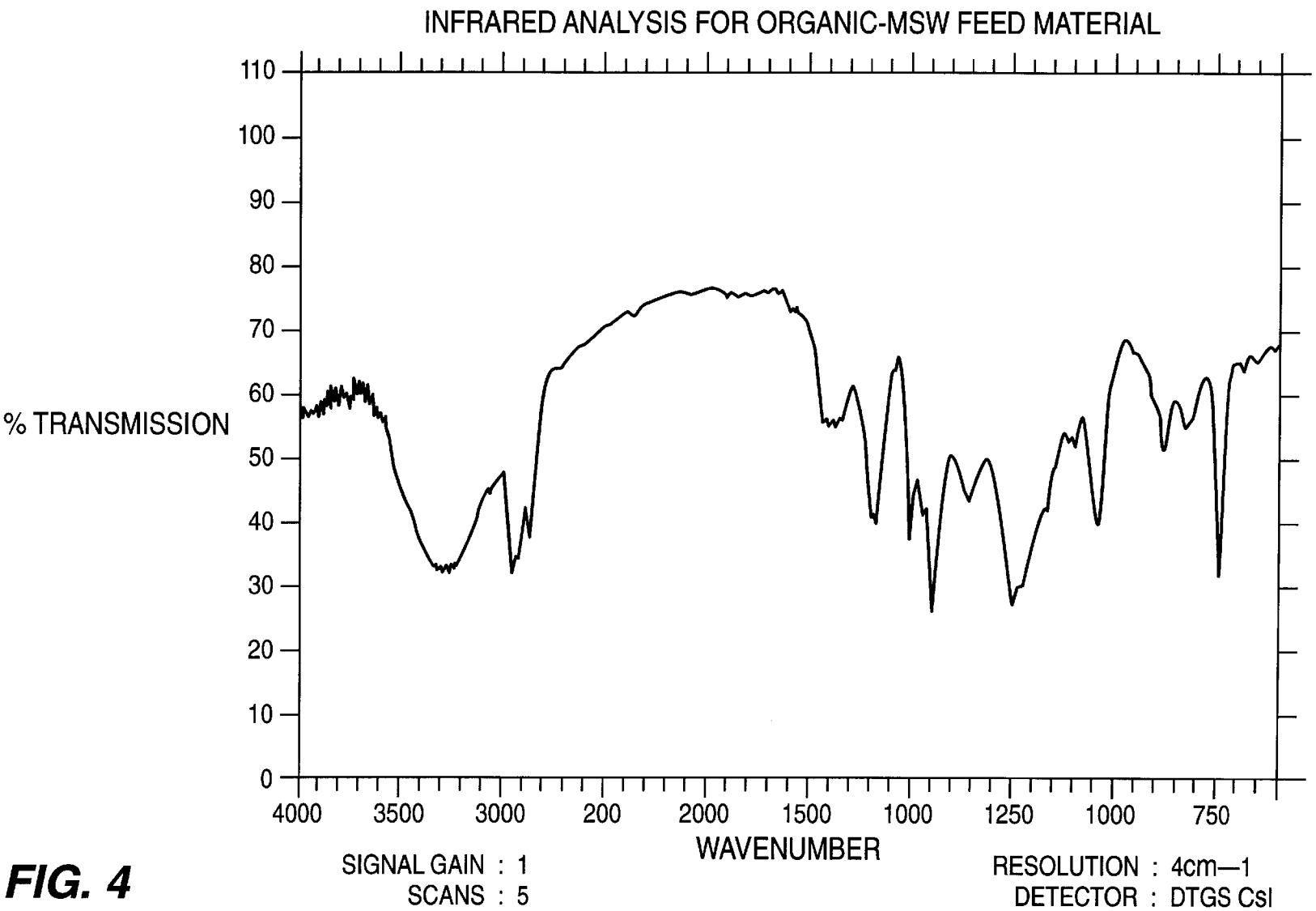
FIG. 4 shows an infrared (IR) analysis spectra of a typical sample of the chemically digested organic-MSW feed material according to this invention

A sample of the unique chemically digested organic-MSW feed material of this invention was characterized by infared (IR) analysis utilizing a suitable Mattson FTIR instrument, with results as shown by FIG. 4. The IR spectra shows the aromatic structure by having wavenumber peaks located between 700–1660 wavenumbers. Also incorporated into the digested organic-MSW material is the presence of intermolecularly hydrogen-bonded hydroxyl groups which is seen at 3300 wavenumbers. Absent from the IR spectra are any strong wavenumber peaks associated with carbonyl functionality (about 1700 wavenumbers)

EXAMPLE No. 2

The basic process of this invention was verified by experimental catalytic hydroconversion runs made by reacting chemically digested organic-MSW feed material samples in a microautoclave reactor unit together with a known particulate catalyst consisting of cobalt-molybdenum on alumina support. The reaction conditions used and results achieved are provided in the following Table 1.

TABLE 1

Hydroconversion of Chemically Digested Organic-MSW Feed

| | | |
|---|---|---|
| Reaction Temperature, ° C. | 440 | 440 |
| Reaction Temperature, ° F. | 825 | 825 |
| Hydrogen Pressure, psig. | 2000 | 2000 |
| Reaction Time, min. | 60 | 60 |
| THF* Soluble Conversion, wt. % | 93.1 | 95.1 |
| Product Composition, wt. % | | |
| 524° C. Gas + Liquid | 46.2 | 38.7 |
| 524° C.$^+$ Solids | 47.0 | 56.5 |
| THF Insolubles | 6.9 | 7.8 |

*THF denotes tetrahydrofuram solvent

From the results above, it is seen that relatively high hydroconversion of the chemically digested organic-MSW feed material exceeding about 93 wt. % THF-soluble material was achieved for producing desirable high yields of hydrocarbon gas and liquid functions, with only about 7–8 wt. % yield of THF-insoluble materials. The resulting THF-soluble liquid material is useful as hydrocarbon liquid fuels. Further analysis of the liquid fraction product indicated that it contained 5 wt. % of IBP-400° F. napatha fraction, 53 wt. % of 400–650° F. gas oil fraction, and 42 wt. % of 650–975° F. heavy gas oil fraction. For hydroconversion reactions of the chemically digested organic-MSW feed material utilizing a more active catalyst, even higher hydroconversion of the organic-MSW feed material could be achieved.

EXAMPLE No. 3

The technical feasibility of hydroprocessing a 50/50 wt. % blend of the chemically digested organic-MSW material of Example No. 2 together with a particulate bituminous coal and a known particulate cobalt-moly–alumina catalyst was verified by other experimental hydroconversion runs utilizing a microautoclave reactor unit. The reaction conditions used and product results achieved are provided in Table 2 below.

TABLE 2

Hydroconversion of Chemically Digested Organic-MSW Blended with Coal

| | | |
|---|---|---|
| Reaction Temperature, ° C. | 440 | 440 |
| Reaction Temperature, ° F. | 825 | 825 |
| Hydrogen Pressure, psig | 2000 | 2000 |
| Reaction Time, min. | 60 | 60 |
| THF Soluble Conversion, wt. % | 92.4 | 96.1 |
| Product Composition, wt. % | | |
| 524° C. $^-$Gas + Liquid | 25.2 | 24.2 |
| 524° C.$^+$ Solids | 67.0 | 71.9 |
| THF Insolubles | 7.8 | 3.9 |

Based on the above results, it is seen that the chemically digested organic-MSW material blended in a 50/50 wt. % mixture with particulate bituminous coal can be successfully hydroconverted to produce high yields exceeding 92 wt. % of THF-soluble material, which would be useful as liquid fuels such as for transportation fuels, i.e. gasoline, kerosene, and diesel fuel. Further analysis of the liquid fraction product revealed that it contained 10 wt. % IBP-400° F. naphtha, 54 wt. % 400–650° F. gas oil, and 36 wt. % 650–975° F. heavy gas oil. For hydroconversion reactions utilizing a catalyst having higher activity, even higher hydroconversions results to produce more hydrocarbon liquid products could be achieved.

Although this invention has been described broadly and also in terms of preferred embodiments, it will be understood that modifications and variations can be made to the process all within the scope of the invention which is defined by the following claims:

I claim:

1. A process for catalytic hydroconversion of heavy hydrocarbon feed materials at least partially derived from organic municipal solid waste(organic-MSW) material to produce lower boiling hydrocarbon liquid products, the process comprising:

(a) providing a feed material containing at least 50 wt. % chemically digested organic-MSW material which has been chemically digested in a polar acidic organic liquid and contains mainly aromatic and non-carbonyl compounds; reacting said feed material with hydrogen and a suitable hydroconversion catalyst in a reactor under reaction conditions of 600–860° F. (315–460° C.) temperature, 1000–3000 psig hydrogen partial pressure, and fresh feed rate of 20–60 lb/h/ft$^3$ reactor volume, hydrocracking the feed material and generating an effluent material containing vapor and liquid portions;

(b) phase separating said effluent material into its vapor and liquid portions, purifying said vapor portion and recovering hydrogen for recycle to the reactor; and (c) fractionating the effluent liquid portion into desired component fractions based on their normal boiling ranges, and withdrawing hydrocarbon liquid fraction products having a boiling range IBP-975° F.

2. A catalytic hydroconversion process according to claim 1, wherein said chemically digested organic-MSW feed material contains by weight 75–79% carbon, 6–7.5% hydrogen, 14.5–17% oxygen, 0.01–0.05% nitrogen, 0.2–0.5% sulfur, 0.01–0.1% ash, and has a heating value of 14,000–16,000 Btu/lb.

3. A catalytic hydroconversion process according to claim 1, wherein said catalyst is a particulate catalyst containing 0.5–10 wt. % of an active metal including cobalt, iron, molybdenum, or nickel and combinations thereof deposited on a support material including alumina, carbon, silica and combinations thereof.

4. A catalytic hydroconversion process according to claim 1, wherein said catalyst is a fine sized dispersed material containing mainly iron oxide and anions of molybdate, phosphate, sulfate or tungstate or combinations thereof, and the catalyst weight loading relative to the feed material is 500–10,000 wppm iron.

5. A catalytic hydroconversion process according to claim 1, wherein said feed material is organic-MSW feed material alone, the reaction conditions are 650–840° F. (410–450° C.) temperature, 1500–2500 psig hydrogen partial pressure, and the fresh feed rate is 30–60 lb./hr/ft$^3$ reactor volume.

6. A catalytic hydroconversion process according to claim 1, wherein said feed material is reacted in two-staged close-coupled catalytic reactors connected in series.

7. A catalytic hydroconversion process according to claim 1, wherein said feed material is reacted in two staged catalytic reactors connected in series and having an inter-stage gas-liquid phase separation step provided between the two staged reactors.

8. A catalytic hydroconversion process according to claim 1, wherein said chemically digested organic-MSW feed material is blended with heavy petroleum residua.

9. A catalytic hydroconversion process according to claim 1, wherein said chemically digested organic-MSW feed material is blended with particulate coal.

10. A catalytic hydroconversion process according to claim 1, wherein said chemically digested organic-MSW feed material is blended with a mixture of heavy petroleum residua and particulate coal.

11. A catalytic hydroconversion process according to claim 1, wherein said chemically digested organic-MSW feed material is blended with a mixture of heavy petroleum residua and mixed waste plastics.

12. A catalytic hydroconversion process according to claim 1, wherein said chemically digested organic-MSW feed material is blended with petroleum residua, and the reaction conditions are 700–860° F. (371–460° C.) temperature, 1500–3000 psi hydrogen partial pressure, and blended fresh feed rate of 20–50 lb./h/ft$^3$ reactor volume.

13. A catalyst hydroconversion process according to claim 1, including recycling a heavy hydrocarbon liquid fraction having normal boiling range of 650–975° F. back to the catalytic reactor(s).

14. A catalytic hydroconversion process according to claim 8, wherein the first stage reactor utilizes a dispersed slurry hydroconversion catalyst, and the second stage reactor contains an ebullated bed of a particulate supported hydroconversion catalyst.

15. A catalytic hydroconversion process according to claim 9, wherein said chemically digested organic-MSW feed material is 60–80 wt. % of the total feed.

16. A catalytic hydroconversion process according to claim 10, wherein said chemically digested organic-MSW feed material is 60–80 wt. % of the total feed.

17. A catalytic hydroconversion process according to claim 8, wherein the hydrocarbon light liquid fraction having normal boiling range of IBP-750° F. is further processed in an in-line catalytic fixed bed hydrotreating step.

18. A catalytic hydroconversion process according to claim 9, wherein the hydrocarbon light liquid fraction having normal boiling range of IBP-750° F. is further processed in an in-line catalytic fixed bed hydrotreating step.

19. A catalytic hydroconversion process according to claim 10, wherein the hydrocarbon light liquid fraction having normal boiling range of IBP-750° F. is further processed in an in-line catalytic fixed bed hydrotreating step.

20. A catalytic hydroconversion process according to claim 11, wherein the hydrocarbon light liquid fraction having normal boiling range of IBP-750° F. is further processed in an in-line catalytic fixed bed hydrotreating step.

21. A process for catalytic two-stage hydroconversion of heavy hydrocarbon feed material containing at least 50 wt. % chemically digested organic-MSW material to produce lower boiling hydrocarbon liquid products, the process comprising:

(a) blending a non-carbonyl chemically digested organic-MSW feed material which has been chemically digested in phenol and is mainly aromatic together with a heavy petroleum residua, and reacting the blended feedstream with hydrogen in a first stage reactor containing a dispersed slurry catalyst which contains mainly iron oxide and anions of molybdate, phospshate, sulfate or tungstate and mixtures thereof; maintaining reaction conditions of 750–860° F. (400–460° C.) temperature, 1500–2500 psig hydrogen partial pressure, feed rate of 30–50 lb./hr/ft$^3$ reactor, and catalyst weight loading of 500–10,000 ppm iron relative to the blended feed material, hydroconverting the feed material and generating a first effluent material containing vapor and liquid portions;

(b) phase separating said first effluent material into its vapor and liquid portions, passing said liquid portion to a second stage catalytic reactor maintained at the reaction conditions of step (a), and providing a second effluent material containing vapor and liquid portions;

(c) phase separating said second effluent material into its vapor and liquid portions, purifying said second vapor portion and recovering hydrogen for recycle to said reactors;

(d) fractionating said second liquid portion into desired gas and liquid fractions based on their normal boiling ranges, and withdrawing low-boiling hydrocarbon liquid products having normal boiling range of IBP-975° F.; and (e) recycling a hydrocarbon liquid fraction having normal boiling range of 650–975° F. back to the first stage catalytic reactor.

* * * * *